US005997444A

United States Patent [19]

McBride

[11] Patent Number: 5,997,444

[45] Date of Patent: Dec. 7, 1999

[54] SYSTEM FOR SUPPORTING AND ASSISTING PHYSICALLY CHALLENGED USERS FOR GOING ON FOOT

[76] Inventor: Kinney L. McBride, 1770 Hemlock St., Apt. 507, Longview, Wash. 98632

[21] Appl. No.: 09/104,627

[22] Filed: Jun. 25, 1998

[51] Int. Cl.[6] ..... A63B 21/02

[52] U.S. Cl. ..... 482/69; 482/66

[58] Field of Search ..... 482/69, 66; 104/62; 188/5–6

[56] References Cited

U.S. PATENT DOCUMENTS

| | | | |
|---|---|---|---|
| 1,611,807 | 12/1926 | Bergh . | |
| 2,871,915 | 2/1959 | Hogan . | |
| 3,780,663 | 12/1973 | Pettit . | |
| 4,231,568 | 11/1980 | Riley et al. | 272/136 |
| 4,911,426 | 3/1990 | Scales . | |
| 4,973,044 | 11/1990 | Jones . | |

FOREIGN PATENT DOCUMENTS

| | | |
|---|---|---|
| 3011-404 | 10/1981 | Germany . |
| 611-623 | 5/1978 | Russian Federation . |

*Primary Examiner*—Richard J. Apley
*Assistant Examiner*—Lori Baker-Smith
*Attorney, Agent, or Firm*—Parsons & Goltry; Robert A. Parsons; Michael W. Goltry

[57] ABSTRACT

A system for supporting and assisting physically challenged users for going on foot, the system comprising a supporting assembly, a fixture suspended from the supporting assembly, a body-supporting assembly carried by the fixture for embracing and accommodating the user in seated and standing positions a brake mounted with one of the fixture and the body-supporting assembly for movement in reciprocal directions between a first position spaced from a support surface and a second position for abutting the support surface to stabilize the body-supporting assembly.

50 Claims, 5 Drawing Sheets

FIG. 2
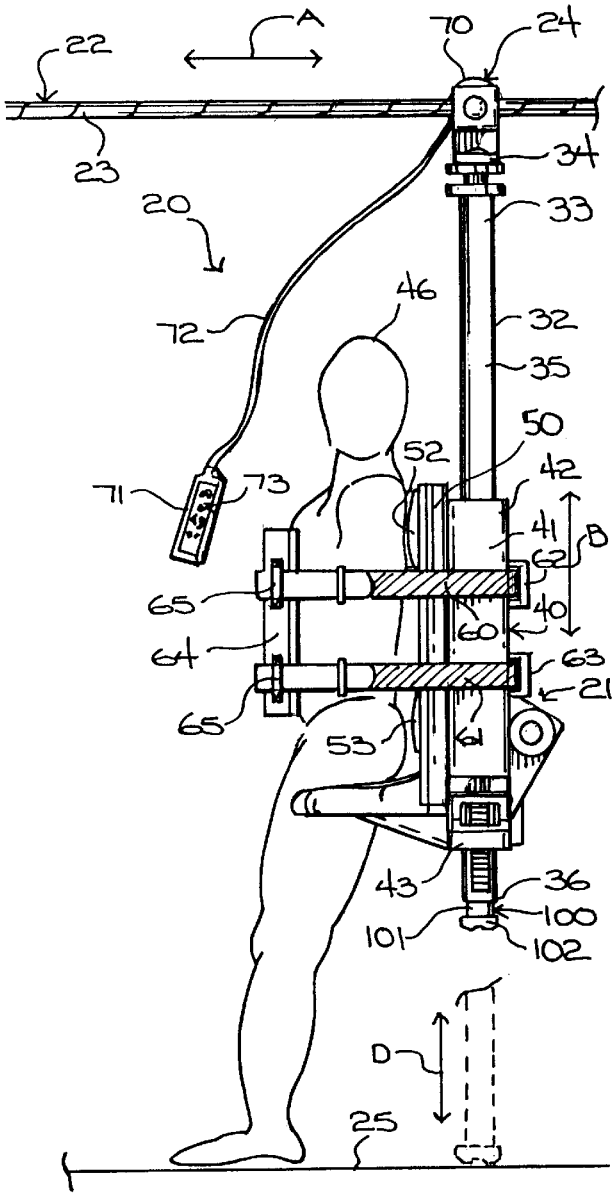
FIG. 3
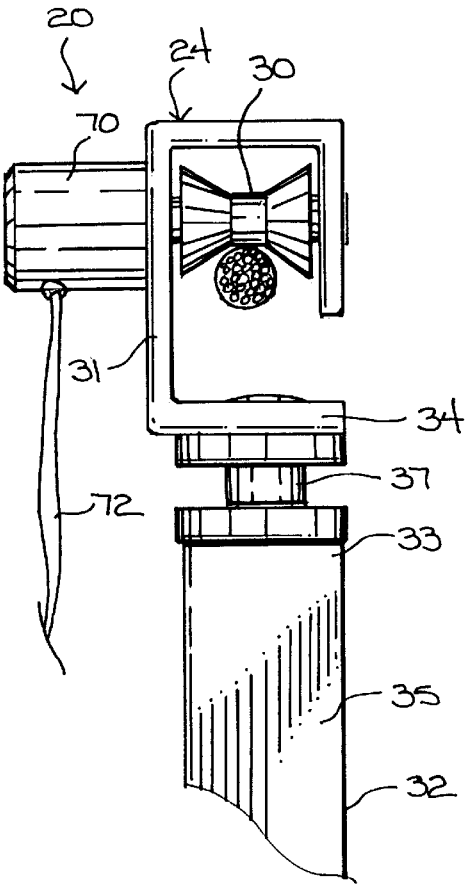
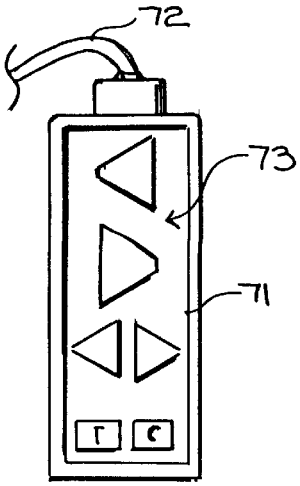
FIG. 4

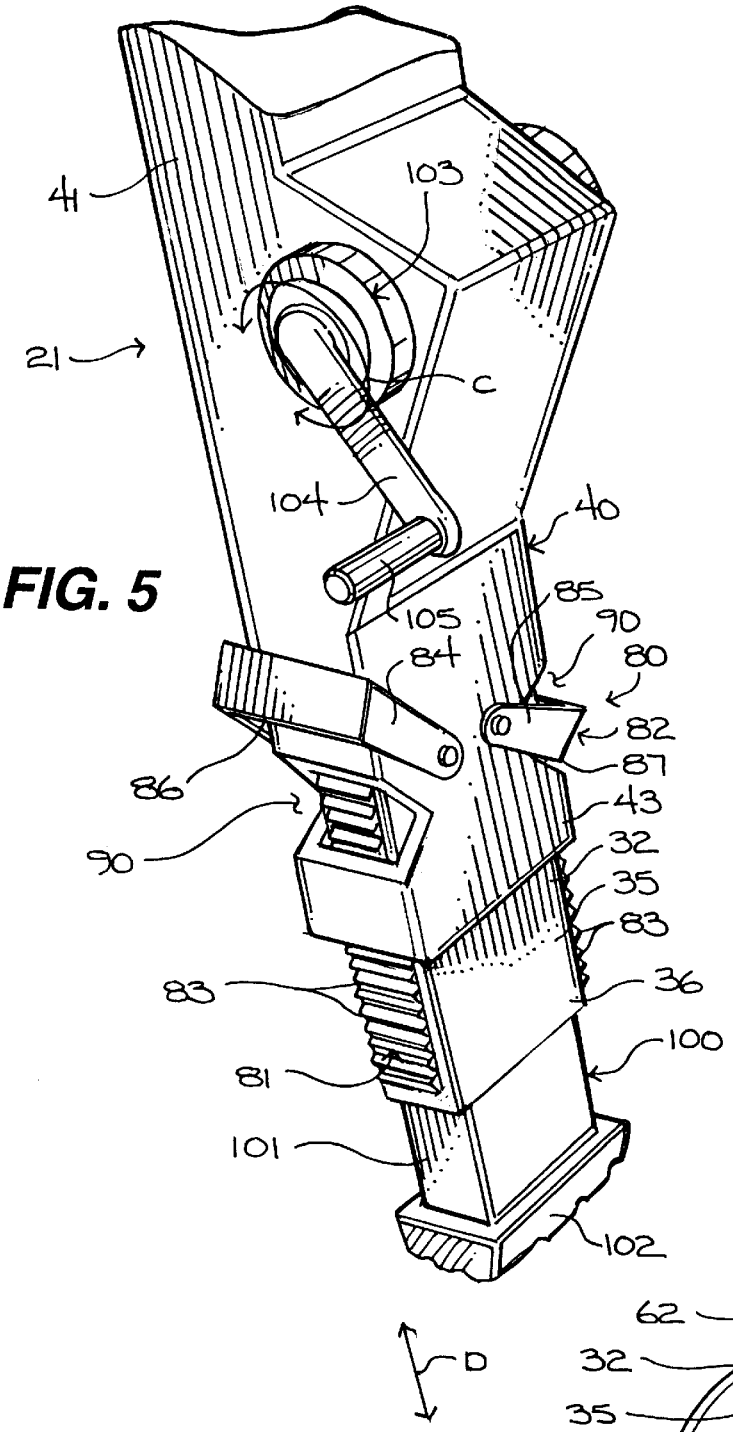
FIG. 5
FIG. 6
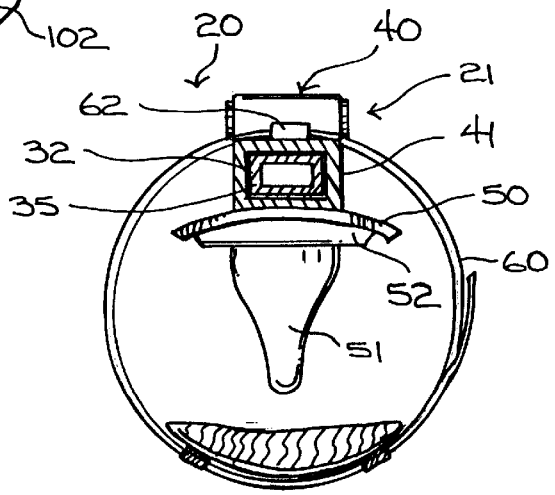

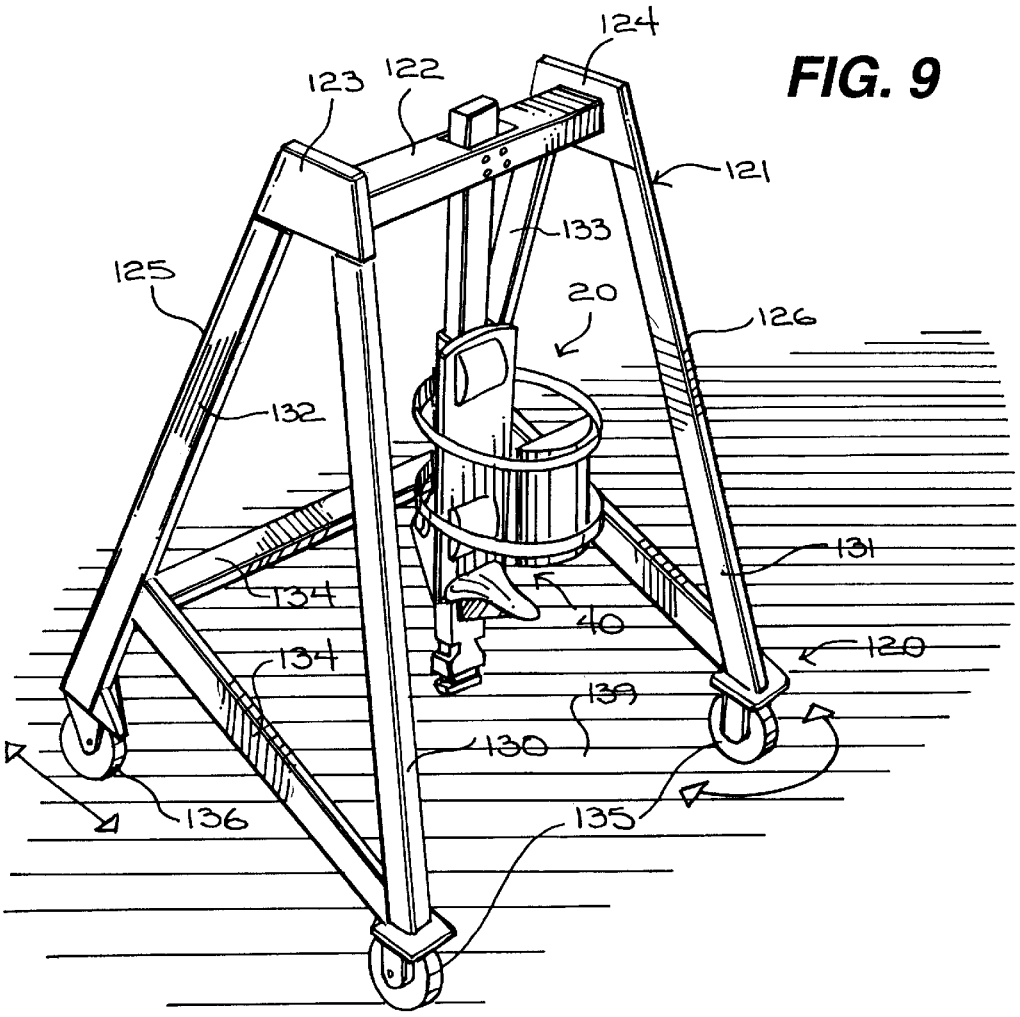
FIG. 9
FIG. 10
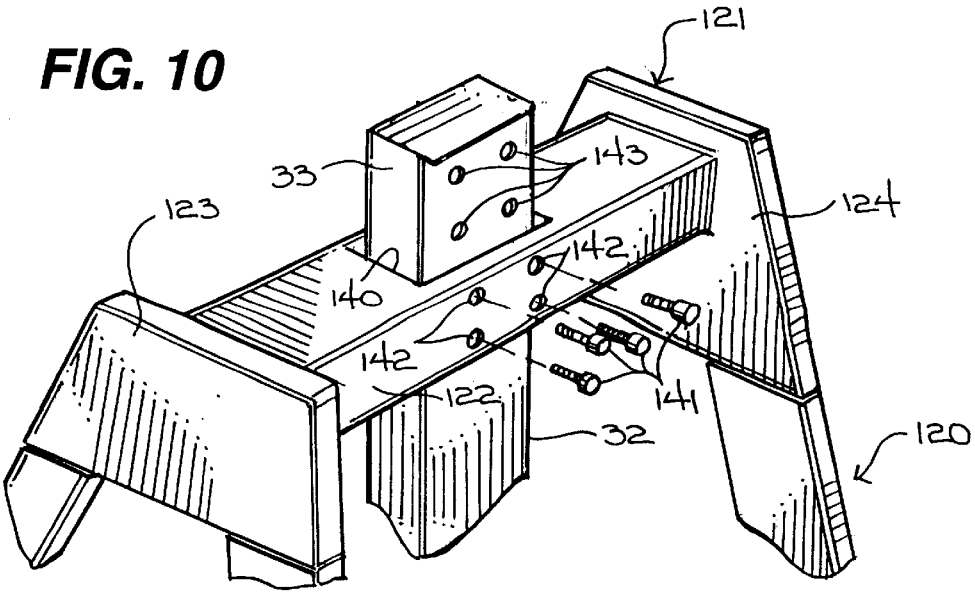

SYSTEM FOR SUPPORTING AND ASSISTING PHYSICALLY CHALLENGED USERS FOR GOING ON FOOT

FIELD OF THE INVENTION

This invention relates generally to the field of ambulatory apparatus and, more particularly, to apparatus and systems for supporting and assisting physically challenged users for going on foot.

BACKGROUND OF THE INVENTION

The prior art is replete with ambulatory apparatus of the type for supporting and assisting physically challenged users in walking, exercise or otherwise going on foot. Many such prior art ambulatory apparatus can be found not only in private residences for permitting physically challenged users to move about in their homes, but also in elderly care and physical therapy facilities. Although exemplary, known ambulatory apparatus are difficult to construct and prove particularly challenging and dangerous for physically challenged users to use independently.

Accordingly, it would be highly desirable to provide improved apparatus and systems for supporting and assisting physically challenged users for walking, exercise or otherwise going on foot.

It is a purpose of the present invention to provide new and improved apparatus and systems for supporting and assisting physically challenged users that are easy to construct.

It is another purpose of the present invention to provide new and improved apparatus and systems for supporting and assisting physically challenged that are easy to use.

It is still another purpose of the present invention to provide new and improved apparatus and systems for supporting and assisting physically challenged users that are easy to install.

It is a further purpose of the present invention to provide new and improved apparatus and systems for supporting and assisting physically challenged users that are inexpensive.

It is still a further provision of the present invention to provide physically challenged users with a sense of independence.

It is yet still a further provision of the present invention to reduce the burdensome costs normally associated with elderly care and with the care of physically challenged people.

It is another provision of the present invention to reduce depression that elderly and physically challenged people normally experience.

It is still another purpose of the present invention to provide new and improved apparatus and systems for supporting and assisting physically challenged users that are safe.

It is yet still another purpose of the present invention to provide new and improved apparatus and systems for supporting and assisting physically challenged users that require no supervision when in use.

SUMMARY OF THE INVENTION

The above problems and others are at least partially solved and the above purposes and others are realized in new and improved apparatus and systems for supporting and assisting physically challenged users for walking, exercise or otherwise going on foot. In a specific embodiment, a system of the present invention may comprise a fixture suspended for movement from a supporting assembly and having a free end directed toward a support surface and a body-supporting assembly carried by the fixture for accommodating the user in a seated position and a standing position. The present invention may further include means carried by one of the fixture and the body-supporting assembly for embracing the user against the body-supporting assembly and a brake mounted with one of the fixture and the body-supporting assembly for movement in reciprocal directions between a first position spaced from the support surface and a second position for abutting the support surface to stabilize the body-supporting assembly for permitting a user to easily and safely mount and dismount the body-supporting assembly. The body-supporting assembly normally carries a body-supporting element for accommodating the user in the seated position.

In a particular embodiment, the body-supporting assembly may be carried by the fixture for reciprocal adjustment. To secure the body-supporting assembly with the fixture at predetermined locations along a predetermined length of fixture, the present invention may further include at least one engagement element carried by the fixture and at least one detachably engagable complemental engagement element carried by the body-supporting assembly. In a preferred embodiment the engagement element may include a selected one of a plurality of detents carried by the fixture at spaced intervals along a predetermined length thereof. The complement engagement element may include a detent engagement element carried by the body-supporting assembly for movement to engage and disengage the selected one of the plurality of detents.

To adjust the brake between the first and second positions and to secure the brake at and between the first and second positions, the present invention may be provided with a crank assembly carried by the brake and the body-supporting assembly. Furthermore, the present invention may also include one or more straps carried by one of the body-supporting assembly and the fixture and for embracing and securing a user against the body-supporting assembly during normal use.

BRIEF DESCRIPTION OF THE DRAWINGS

The foregoing and further and more specific objects and advantages of the instant invention will become readily apparent to those skilled in the art from the following detailed description thereof taken in conjunction with the drawings in which:

FIG. 2 illustrates a side elevational view of the system of FIG. 1 shown as it would appear in use;

FIG. 3 illustrates a fragmented front elevational view of the supporting assembly of FIG. 1;

FIG. 4 illustrates a rheostat switch for operating the motorized trolley of FIG. 1;

FIG. 5 illustrates a fragmented perspective view of the body-supporting assembly of FIG. 1, further illustrating a brake adjustable in reciprocal directions for engaging a support surface for stabilizing the body-supporting assembly;

FIG. 6 illustrates a top elevational view of the body-supporting assembly of FIG. 1;

FIG. 9 illustrates a perspective view of the body-supporting apparatus of FIG. 1 shown as it would appear suspended from a wheeled frame; and FIG. 10 illustrates a fragmented perspective view of the body-supporting apparatus of FIG. 9 shown as it would appear engagable with the wheeled frame.

DETAILED DESCRIPTION OF A PREFERRED EMBODIMENT

The present invention provides, among other things, improved systems and apparatus for supporting and assisting physically challenged user for walking, exercise or otherwise going on foot. Ensuing embodiments of the present invention are particularly useful for users having a limited ability to walk and/or exercise independent of either physical aids such as crutches and walkers, and/or mechanical aid provided from, for instance, health care or physical therapy professionals.

Figure 1:
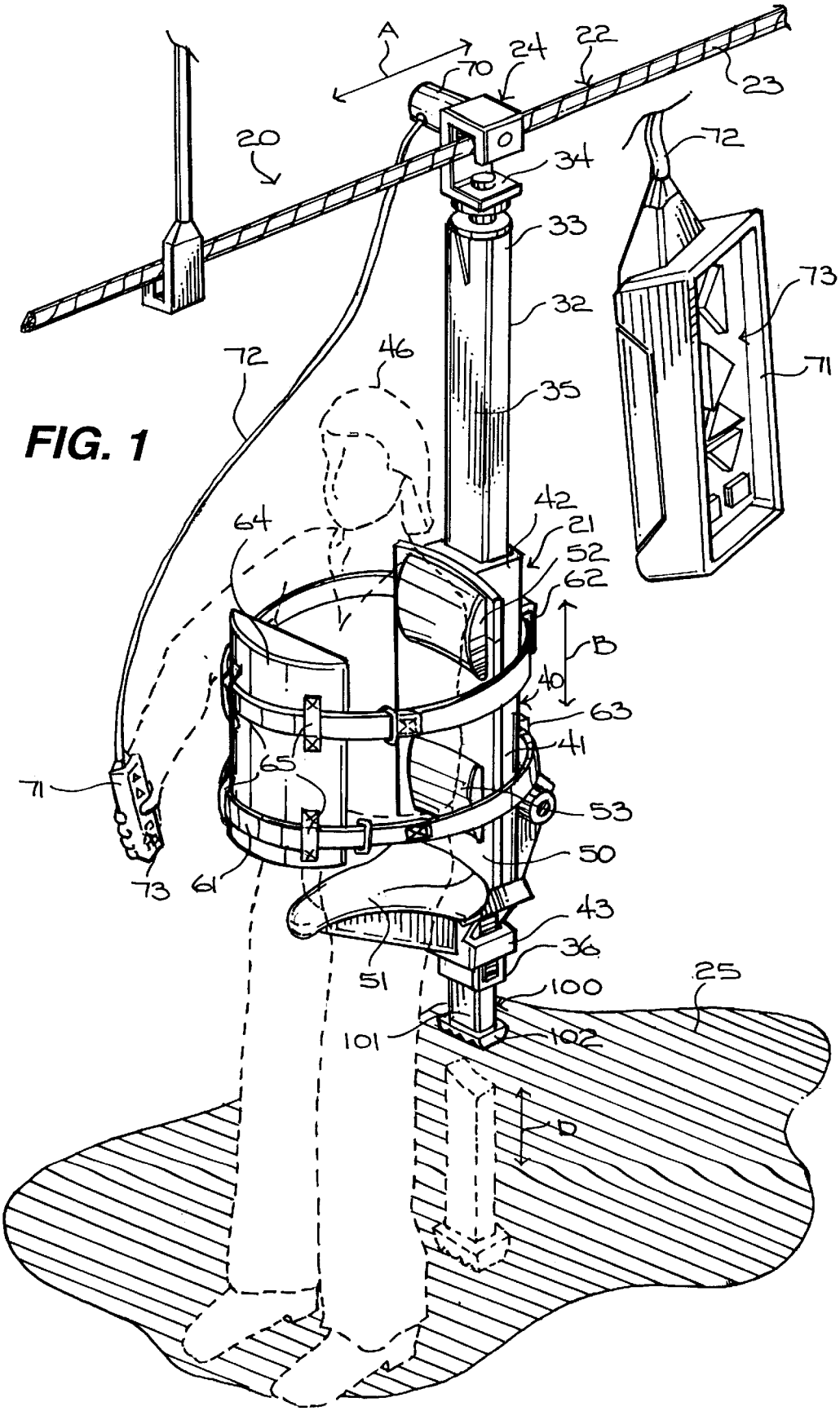
FIG. 1 illustrates a perspective view of a system for supporting and assisting a physically challenged user for going on foot and for exercise, the system generally comprising body-supporting apparatus suspended above a support surface and including a body-supporting assembly for accommodating a user in seated and standing positions, body-supporting apparatus further shown as it would appear suspended from a cable and having a motorized trolley mounted with the cable for riding thereon, in accordance with the present invention.

Turning now to the drawings, in which like reference characters indicate corresponding elements throughout the several views, attention is first directed to FIG. 1 illustrating a perspective view of a system 20 for supporting and assisting a physically challenged user for going on foot and for exercise, in accordance with the present invention. System 20 is generally comprised of body-supporting apparatus 21 suspended from a supporting assembly 22 shown as a cable 23 in this embodiment. Body-supporting apparatus 21 is operative for accommodating a user in seated and standing positions. Cable 23 may be fixed or otherwise hung by conventional means within a structure such as a home, hospital or clinic, or perhaps out of doors between adjacent natural or man-made structures, trees, etc.

With continuing reference to FIG. 1 and additional reference to FIG. 2, body-supporting apparatus 21 is carried by or otherwise suspended from cable 23 via a trolley 24 mounted with cable 23 for movement in reciprocal directions along cable 23 as generally indicated by the double arrowed line A, body-supporting apparatus 21 extending downwardly therefrom toward a support surface 25. Regarding FIG. 3, trolley 24 comprises a wheel 30 journaled for rotation with a base 31 and supported against cable 23 for wheeled movement. Those having regard toward the relevant art will readily understand that trolleys of the general type herein set forth for wheeled movement over a cable may be readily found throughout industry. In this regard, although trolley 24 represents a preferred means of suspending body-supporting apparatus 21 from and for movement in reciprocal directions along cable 23, other trolley mechanisms may also be used without departing from the invention.

With attention directed back to FIGS. 1 and 2, body-supporting apparatus 21 comprises a fixture 32 having an end 33 coupled to a free end 34 of base 31. Fixture 32, of which preferably comprises a column 35 constructed of tubular metallic stock or other substantially rigid material, extends downwardly from base 31 and terminates with a free end 36 directed toward support surface 25. Regarding FIG. 3, end 33 of fixture 32 is preferably mounted with free end 34 of base 31 for rotational or pivotal movement via a pin 37.

Carried by fixture 32 is a body-supporting assembly 40. Body-supporting assembly 40 is operative for accommodating a user, such as user 46 in FIGS. 1 and 2, in a seated position shown substantially in FIG. 2 and a standing position shown substantially in FIG. 1 in dotted outline for allowing user 46 to walk, exercise or otherwise go on foot. In this specific embodiment, body-supporting assembly 40 is generally comprised of a sleeve 41 through which fixture 32 extends (shown also in FIG. 6). Sleeve 41, of which may be constructed tubular metallic stock or other substantially rigid material, is carried by fixture 32 for movement and adjustment in reciprocal directions relative to and along a predetermined length of fixture 32 between end 33 and free end 36 as generally indicated by the double arrowed line B in FIGS. 1 and 2. Fixture 32 includes a first end 42 directed toward cable 23 and a second end 43 directed toward support surface 25.

Carried by sleeve 41 is a backrest 50 extending substantially from first end 42 to second end 43 and a body-supporting element or seat 51 carried by and extending outwardly from sleeve 41 and backrest 50 adjacent second end 43 of sleeve 41. Seat 51 is elongate and operative for receiving portions of the body of user 46 thereon in the seated position and, more particularly, the buttocks of user 46 thereon in the seated position. As best shown in FIGS. 1 and 6, backrest 50 is curved somewhat and is operative for receiving portions of the body of user 46 thereagainst in the seated and standing positions and, more particularly, the back of user 46 thereagainst in the seated and standing positions. In the interests of comfort, backrest 50 may further include spaced-apart pads 52 and 53 if so desired for receiving thereagainst the back of user 46.

To secure user 46 with body-supporting assembly 40 in the standing and seated positions as shown substantially in FIGS. 1 and 2, body-supporting assembly 40 may further include a pair of straps 60 and 61 carried in spaced relation by brackets 62 and 63 fixed to sleeve 41 opposite backrest 50. Straps 60 and 61 are operative for wrapping about and embracing user 46 and are preferably adjustable by means of buckles, conventional hook and loop fastening mechanisms commonly found under the exemplary trademark VELCRO® or other conventional adjustment mechanism for allowing straps 60 and 61 to accommodate users of varying size. In the interests of comfort and added support, straps 60 and 61 may be provided with a chest support or plate 64 receivable against the chest of user 46. Chest plate 64 may be provided with grommets 65 into and through which straps 60 and 61 may be received for supporting chest plate 64 thereon. Those of ordinary skill will readily understand that straps 60 and 61 may be mounted and sized as desired for accommodating users of varying size. In this vein, chest plate 64 may also be designed and sized as desired for accommodating users of varying size.

In operation, user 46 may mount body-supporting assembly 40 by either standing with his or her back adjacent backrest 50 or sitting upon seat 51. User 46 may then secure straps 60 and 61 about his or her upper torso with chest plate 64 positioned against his or her chest. So secured with body-supporting assembly 40, user 46 may then walk, exercise or otherwise go on foot generally in the standing position in one or more predetermined directions as generally defined by cable 23. Because body-supporting apparatus 21 is suspended from cable 23 for wheeled movement via trolley 24, body-supporting apparatus 21 will follow user 46 during exercise or walking movement. Should user 46 fall or suffer from momentary imbalance, body-supporting apparatus 21 and seat 51 will catch the user to prevent needless injury. Furthermore, should user 46 become tired or fatigued, he or she may move into the seated position upon seat 51 for rest. The pivotal or rotational attachment of end 33 of fixture 32 with free end 34 of base 31 permits user 46 to pivot or otherwise rotate body-supporting apparatus 21 as needed to allow user 46 to progress in selected directions along cable 23. To dismount from body-supporting assembly 40 after use, user 46, whether in the standing or seated position, disengage straps 60 and 61 and then exit body-supporting assembly 40.

To increase the ease of movement of body-supporting apparatus 21 along cable 23, and with attention directed back to FIGS. 1–3, trolley 24 may be provided with a motor 70 for driving wheel 30 in one or more rotational directions for propelling trolley 24 and body-supporting apparatus 23 along cable 23. Motor 70, of which may be provided as a conventional electrical motor shown carried by base 31 opposite wheel 30 in FIGS. 1 and 3, may be operated by user 46 by way of a rheostat switch 71 coupled with motor 70 by electrical interconnection 72. Having controls 73 for regulating the speed and direction of rotation of wheel 30 and hence the direction of travel of trolley 24, rheostat switch 71 may be carried by user 46, such as by his or her hand as shown, and controls 73 selectively actuated for controlling the operation of trolley 24 as desired.

As user 46 walks or engages in exercise, it is important for seat 51 to reside between the legs of user 46 below his or her crotch area so as to not interfere with walking or exercise movement, and for second end 43 of sleeve 41 to reside proximate or otherwise adjacent the buttocks of user 46 so as not to interfere with movement of the legs of user 46. In this regard, and with attention directed to FIG. 5, body-supporting assembly 40 may be moved in reciprocal directions along fixture 32 as needed to a desired location and then secured in place by virtue of engagement apparatus 80. In this specific example, engagement apparatus 80 includes an engagement assembly 81 carried by fixture 32 and a detachably engagable complemental engagement assembly 82 carried by body-supporting assembly 40 and, more particularly, by sleeve 41.

In this specific example, engagement assembly 81 comprises a plurality of detent members 83 carried by and on opposing sides of fixture 32. Complemental engagement assembly 82 comprises first and second locking members 84 and 85 each having a detent engaging or receiving element 86 and 87, respectively. First and second locking members 84 and 85 are each carried by sleeve 41 for movement in pivotal directions in substantial opposition to detents 83 revealed through windows 90 and 91 formed through sleeve 41. The first and second locking members 84 and 85 are each movable in pivotal directions between first and second positions for detaching each detent engaging element 86 and 87 from a selected one of detents 83 and for engaging and securing each detent engaging element 86 and 87 with a selected one of detents 83 for securing body-supporting assembly 40 in place at a desired location. Although the first and second locking members 84 and 85 together prove exemplary for securing body-supporting assembly 40 in place, only one may be used if so desired.

To promote safe operation of system 20, it is important for body-supporting assembly 40 to be stable for permitting a user to easily and safely mount and dismount body-supporting assembly 40. To this end, and with attention directed to FIGS. 1, 2 and 5, the present invention may further include a brake 100 that may be mounted with one of body-supporting assembly 40 and fixture 32 for movement in reciprocal directions between first and second or retracted and extended positions as generally indicated by the double arrowed line D. In the embodiment set forth in FIGS. 1, 2, and 5, brake 100 is comprised of an elongate body 101 mounted partially within free end 36 of fixture 32 for movement in reciprocal directions and having a free end or foot 102 directed, as shown in FIGS. 1 and 2, toward support surface 25. Brake 100 may be moved in reciprocal directions between a retracted position toward free end 36 of fixture 32 for permitting normal use of system 20 and an extended position shown in dotted outline away from free end 36 to abut or otherwise engage foot 102 against support surface 25 to stabilize body-supporting apparatus 21. So stabilized, user 46 may easily and safely mount and dismount body-supporting assembly 40 of body-supporting apparatus 21 without fear of body-supporting apparatus 21 swinging or falling away which may otherwise cause needless and unwanted bodily injury. After safe mounting, user 46 may retract brake 100 for allowing normal use of body-supporting apparatus 21.

To move brake 100 in reciprocal directions between the retracted and extended positions, the present invention may be provided with a crank assembly 103. As shown in FIG. 5, crank assembly 103 may be contained and carried by body-supporting assembly 40 and brake 100 and may include a crank 104 having a handle 105 that may be grasp, such as by a human hand, for rotating crank in one or more rotational directions. Although not shown, crank assembly 103, like well known crank assemblies, may include a pinion assembly fixed to crank 104 and contained by sleeve 41 of body-supporting assembly 40 and a rack carried by brake 100 in meshing engagement with the pinion assembly. In this regard, crank 104 may be rotated in one or more predetermined directions as generally indicated by the circular double arrowed line C for working the pinion assembly against the rack to impart reciprocal movement to brake 100 between the retracted and extended positions. It will be generally understood that whether in the seated or standing position mounted with body-supporting assembly 40, a user may easily reach back, grasp and actuate crank 104 as needed for moving brake 100 between the retracted and extended positions. Furthermore, although crank 104 assembly is disclosed as operative through manual manipulation, it may be motorized and, for instance, coupled with rheostat switch 71 in electrical communication for selective operation via controls 73.

Figure 7:
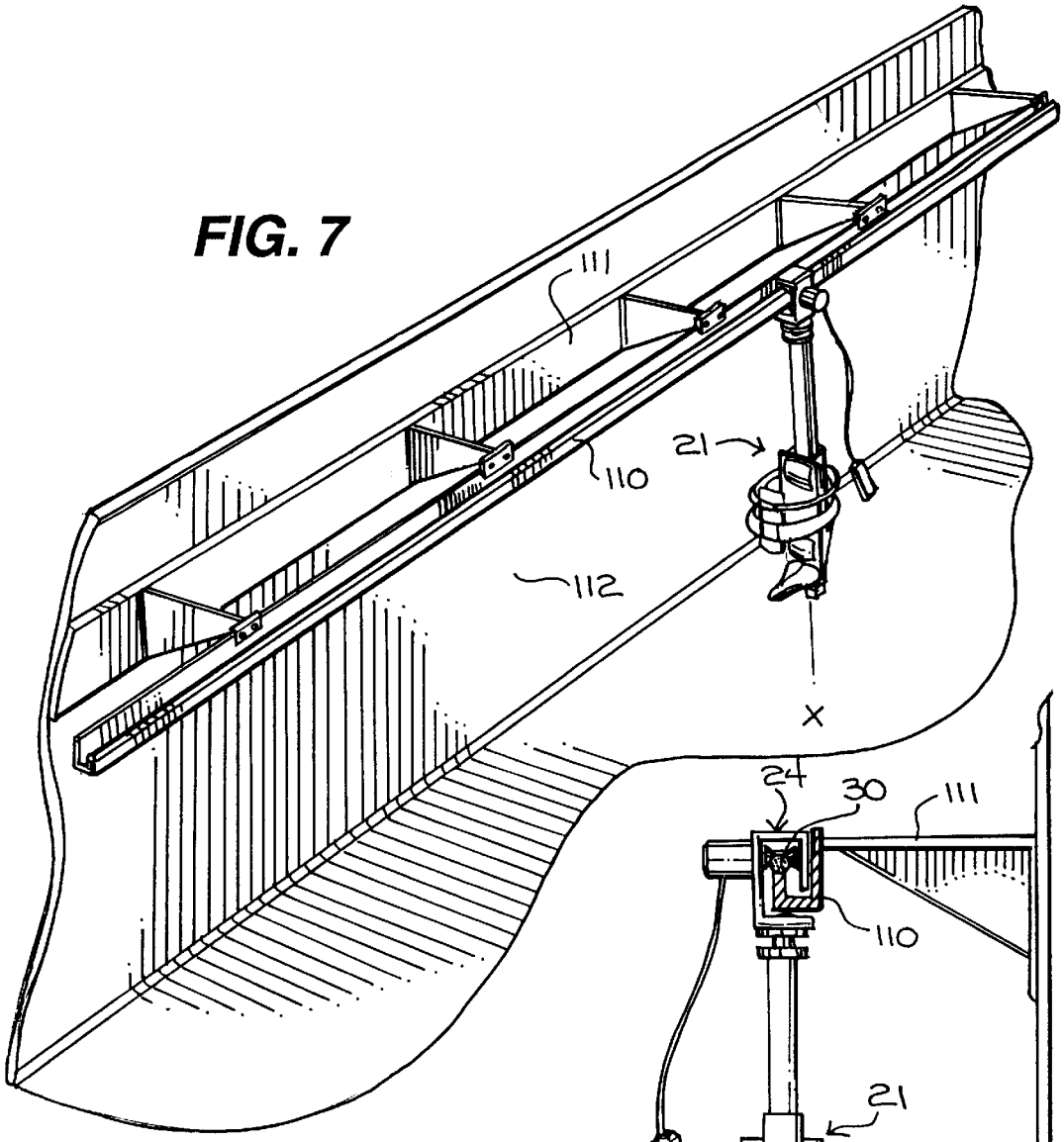
FIG. 7 illustrates a perspective view of the body-supporting apparatus of FIG. 1 shown as it would appear suspended from a track.
Figure 8:
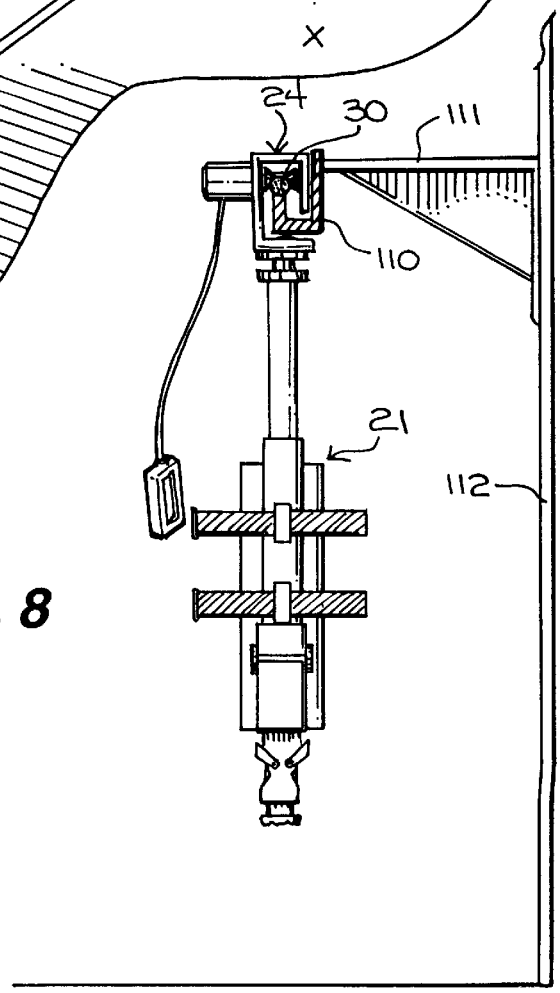
FIG. 8 illustrates a front elevational view of the body-supporting apparatus and track of FIG. 7.

It will be readily understood by those having regard toward the art body-supporting apparatus 21 may be suspended in a variety of ways suitable for permitting physically challenged users to engage in walking and exercise activity. For instance, FIGS. 7 and 8 illustrate body-supporting apparatus 21 suspended from a track 110 mounted to a track supporting assembly 111 coupled to an upright wall 112, wheel 30 of trolley 24 shown as it would appear mounted against track 110 for wheeled movement.

Furthermore, rather than suspending body-supporting apparatus 21 for wheeled movement over a cable or a track, body-supporting apparatus 21 may be suspended from a wheeled frame 120 as shown in FIG. 9. In the specific embodiment set forth in FIG. 9, wheeled frame 120 comprises a frame 121 including a transom 122 fixed at either end to an upper end 123 and 124 of first and second leg assemblies 125 and 126 disposed in spaced relation. First and second leg assemblies 125 and 126 each include a front leg 130 and 131 and a rear leg 132 and 133, respectively, extending outwardly from a respective one of the upper ends 123 and 124. Front legs 130 and 131 and rear legs 132 and 133 terminate with front wheels 135 and rear wheels 136, respectively, for supporting frame 121 for wheeled movement over a support surface 139. To supply frame 121 with structural support and rigidity, frame 121 may further include a plurality of stringers 134 interconnecting front leg 130 with rear leg 132, rear leg 132 with rear leg 133, and rear leg 133 with front leg 131 proximate their lower ends.

To suspend body-supporting apparatus 21 from wheeled frame 120, and with momentary attention directed to FIG. 10, end 33 of fixture 32 may be fastened with transom 122. Although a variety of mechanical engagement mechanisms may be used for fastening end 33 of fixture 32 with transom, the present embodiment illustrates how end 33 of fixture 32 may be received into and through a channel 140 formed through transom 122 intermediate upper ends 123 and 124 of frame 121. To fasten fixture 32 with transom, the present embodiment may include threaded fasteners 141 threadably receivable into and through threaded apertures 142 formed into and through transom 122 in opposition to channel 140 and corresponding threaded apertures 143 extending into fixture 32 adjacent end 33.

In operation, a user may mount body-supporting assembly 40 and then walk, exercise or otherwise go on foot to propel wheeled frame 120 over support surface 139. If desired, front wheels 135 may be journaled with front legs 130 and 131 for rotation or for pivotal movement to permit a user to shift his or her body weight to steer wheeled frame 120 as needed. Furthermore, front legs 130 and 131 are spaced apart to an extent sufficient to allow an user to easy mount and dismount body-supporting assembly 40 therebetween and to minimize obstruction during normal use.

In summary, the present invention provides an exemplary apparatus and systems for supporting and assisting physically challenged user for walking, exercise or otherwise going on foot. The foregoing embodiments of the present invention are easy to construct, easy to use and, with the use of brake 100, may be used independently by physically challenged people without supervision. As a result, exemplary embodiments of the present invention provide elderly and physically challenged users with a sense of independence which can greatly enhance personal and emotional health.

The present invention has been described above with reference to a preferred embodiment. However, those skilled in the art will recognize that changes and modifications may be made in the described embodiments without departing from the nature and scope of the present invention. For instance, although seat 51 has been disclosed as mounted for movement in reciprocal directions relative fixture 32 with sleeve 41, seat 51 may be mounted directly to fixture 32 for reciprocal movement relative thereto if so desired. To this end, seat 51 may be mounted into a longitudinal channel formed into and through fixture 32. Furthermore, seat 51 may be provided with a detent engagement mechanism engagable with a complemental detent engagement mechanism carried by the fixture 32 adjacent the channel for permitting selective reciprocal adjustment of seat 51 as desired consistent with the teachings herein set forth. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A system for supporting and assisting physically challenged users for going on foot, the system comprising:

a fixture suspended for movement and having a free end directed toward a support surface;

a body-supporting assembly carried by the fixture for accommodating the user in a seated position and a standing position;

means carried by one of the fixture and the body-supporting assembly for embracing the user against the body-supporting assembly; and a brake mounted with one of the fixture and the body-supporting assembly for movement in reciprocal directions between a first position spaced from the support surface and a second position for abutting the support surface to stabilize the body-supporting assembly.

2. The system of claim 1, wherein the body-supporting assembly carries a body-supporting element for accommodating the user in the seated position.

3. The system of claim 1, wherein the body-supporting assembly is carried by the fixture for reciprocal adjustment.

4. The system of claim 3, further including means for securing the body-supporting assembly with the fixture.

5. The system of claim 4, wherein the means for securing the body-supporting assembly with the fixture includes:

at least one engagement element carried by the fixture; and at least one detachably engagable complemental engagement element carried by the body-supporting assembly.

6. The system of claim 5, wherein the engagement element includes a selected one of a plurality of detents carried by the fixture at spaced intervals along a predetermined length thereof.

7. The system of claim 6, wherein the complement engagement element includes a detent engagement element carried by the body-supporting assembly for movement to engage and disengage the selected one of the plurality of detents.

8. The system of claim 1, further including means for securing the brake at a selected position between the first and second positions and for adjusting the brake between the first and second positions.

9. The system of claim 8, wherein the means for securing the brake at a selected position between the first and second positions and for adjusting the brake between the first and second positions includes a crank assembly carried by the brake and the body-supporting assembly.

10. The system of claim 1, wherein the means carried by one of the fixture and the body-supporting assembly for embracing the user against the body-supporting assembly includes at least one strap.

11. A system for supporting and assisting physically challenged users for going on foot, the system comprising:

a column suspended for movement and having a free end directed toward a support surface;

a body-supporting assembly carried by the column for accommodating the user in a seated position and a standing position and for reciprocal adjustment; and means carried by one of the column and the body-supporting assembly for embracing the user against the body-supporting assembly.

12. The system of claim 11, wherein the body-supporting assembly carries a body-supporting element for accommodating the user in the seated position.

13. The system of claim 11, further including means for securing the body-supporting assembly with the column.

14. The system of claim 13, wherein the means for securing the body-supporting assembly with the column includes:

at least one engagement element carried by the column; and at least one detachably engagable complemental engagement element carried by the body-supporting assembly.

15. The system of claim 14, wherein the engagement element includes a selected one of a plurality of detents carried by the column at spaced intervals along a predetermined length thereof.

16. The system of claim 15, wherein the complement engagement element includes a detent engagement element carried by the body-supporting assembly for movement to engage and disengage the selected one of the detents.

17. The system of claim 11, further including a brake mounted with one of the column and the body-supporting assembly for movement in reciprocal directions between a first position spaced from the support surface and a second position for abutting the support surface to stabilize the body-supporting assembly.

18. The system of claim 17, further including means for securing the brake at a selected position between the first and second positions and for adjusting the brake between the first and second positions.

19. The system of claim 18, wherein the means for securing the brake at a selected position between the first and second positions and for adjusting the brake between the first and second positions includes a crank assembly carried by the brake and the body-supporting assembly.

20. The system of claim 11, wherein the means carried by one of the column and the body-supporting assembly for embracing the user against the body-supporting assembly includes at least one adjustable strap.

21. A system for supporting and assisting physically challenged users for going on foot, the system comprising:

a supporting assembly;

a fixture suspended from the supporting assembly and having a free end directed toward a support surface;

a body-supporting assembly carried by the fixture for accommodating the user in a seated position and a standing position;

means carried by one of the fixture and the body-supporting assembly for embracing the user against the body-supporting assembly; and a brake mounted with one of the fixture and the body-supporting assembly for movement in reciprocal directions between a first position spaced from the support surface and a second position for abutting the support surface to stabilize the body-supporting assembly.

22. The system of claim 21, wherein the body-supporting assembly carries a body-supporting element for accommodating the user in the seated position.

23. The system of claim 21, wherein the body-supporting assembly is carried by the fixture for reciprocal adjustment.

24. The system of claim 23, further including means for securing the body-supporting assembly with the fixture.

25. The system of claim 24, wherein the means for securing the body-supporting assembly with the fixture includes:

at least one engagement element carried by the fixture; and at least one detachably engagable complemental engagement element carried by the body-supporting assembly.

26. The system of claim 25, wherein the engagement element includes a selected one of a plurality of detents carried by the fixture at spaced intervals along a predetermined length thereof.

27. The system of claim 26, wherein the complement engagement element includes a detent engagement element carried by the body-supporting assembly for movement to engage and disengage the selected one of the plurality of detents.

28. The system of claim 21, further including means for securing the brake at and at selected positions between the first and second positions and for adjusting the brake between the first and second positions.

29. The system of claim 28, wherein the means for securing the brake at and at selected positions between the first and second positions and for adjusting the brake between the first and second positions includes a crank assembly carried by the brake and the body-supporting assembly.

30. The system of claim 21, wherein the means carried by one of the fixture and the body-supporting assembly for embracing the user against the body-supporting assembly includes at least one strap.

31. The system of claim 21, wherein the support assembly includes a wheeled frame.

32. The system of claim 21, wherein the support assembly includes a track.

33. The system of claim 21, wherein the support assembly includes a cable.

34. The system of claim 21, wherein the fixture is suspended from the support assembly for wheeled movement.

35. The system of claim 21, wherein the fixture is suspended form the support assembly for motorized-wheeled movement.

36. A system for supporting and assisting physically challenged users for going on foot, the system comprising:

a supporting assembly;

a column suspended from the supporting assembly for movement and having a free end directed toward a support surface;

a body-supporting assembly carried by the column for accommodating the user in a seated position and a standing position and for reciprocal adjustment; and means carried by one of the column and the body-supporting assembly for embracing the user against the body-supporting assembly.

37. The system of claim 36, wherein the body-supporting assembly carries a body-supporting element for accommodating the user in the seated position.

38. The system of claim 36, further including means for securing the body-supporting assembly with the column.

39. The system of claim 38, wherein the means for securing the body-supporting assembly with the column includes:

at least one engagement element carried by the column; and at least one detachably engagable complemental engagement element carried by the body-supporting assembly.

40. The system of claim 39, wherein the engagement element includes a selected one of a plurality of detents carried by the column at spaced intervals along a predetermined length thereof.

41. The system of claim 40, wherein the complement engagement element includes a detent engagement element carried by the body-supporting assembly for movement to engage and disengage the selected one of the plurality of detents.

42. The system of claim 36, further including a brake mounted with one of the column and the body-supporting assembly for movement in reciprocal directions between a first position spaced from the support surface and a second position for abutting the support surface to stabilize the body-supporting assembly.

43. The system of claim 42, further including means for securing the brake at and at selected positions between the first and second positions and for adjusting the brake between the first and second positions.

44. The system of claim 43, wherein the means for securing the brake at and at selected positions between the first and second positions and for adjusting the brake between the first and second positions includes a crank assembly carried by the brake and the body-supporting assembly.

45. The system of claim 36, wherein the means carried by one of the column and the body-supporting assembly for embracing the user against the body-supporting assembly includes at least one adjustable strap.

46. The system of claim 36, wherein the support assembly includes a wheeled frame.

47. The system of claim 36, wherein the support assembly includes a track.

48. The system of claim 36, wherein the support assembly includes a cable.

49. The system of claim 36, wherein the column is suspended from the support assembly for wheeled movement.

50. The system of claim 36, wherein the column is suspended form the support assembly for motorized-wheeled movement.

* * * * *